US006698356B2

(12) United States Patent
Rosu

(10) Patent No.: US 6,698,356 B2
(45) Date of Patent: Mar. 2, 2004

(54) AXIAL SPIN METHOD OF DISTRIBUTING PYROTECHNIC CHARGE IN AN INITIATOR

(75) Inventor: Marius Rosu, Woodland Hills, CA (US)

(73) Assignee: Special Devices, Incorporated, Moorpark, CA (US)

( * ) Notice: Subject to any disclaimer, the term of this patent is extended or adjusted under 35 U.S.C. 154(b) by 58 days.

(21) Appl. No.: 10/188,009

(22) Filed: Jul. 1, 2002

(65) Prior Publication Data

US 2004/0000247 A1 Jan. 1, 2004

(51) Int. Cl.[7] ..... F42B 3/12; F42B 3/10; F42B 3/14

(52) U.S. Cl. ..... 102/202.5; 102/202.7; 102/202.8; 102/202.9; 102/202.14

(58) Field of Search ..... 102/202.5, 202.7, 102/202.8, 202.9, 202.14; 86/1.1, 20.1

(56) References Cited

U.S. PATENT DOCUMENTS

| | | | | | |
|---|---|---|---|---|---|
| 3,546,997 | A | * | 12/1970 | Gould et al. | 86/1 |
| 4,247,294 | A | * | 1/1981 | Carter | 264/3 |
| 4,336,209 | A | * | 6/1982 | Gylden et al. | 264/3 |
| 5,686,691 | A | | 11/1997 | Hamilton et al. | 102/202.5 |

* cited by examiner

*Primary Examiner*—Michael J. Carone
*Assistant Examiner*—Aileen B. Felton
(74) *Attorney, Agent, or Firm*—Law Offices of Thomas J. Brindisi

(57) ABSTRACT

A method of axially spinning an initiator subassembly after the loading of a pyrotechnic charge therein, in order to distribute the charge.

20 Claims, 1 Drawing Sheet

AXIAL SPIN METHOD OF DISTRIBUTING PYROTECHNIC CHARGE IN AN INITIATOR

BACKGROUND OF THE INVENTION

The present invention generally relates to the field of pyrotechnic initiators, and more particularly to a method of axially spinning an initiator subassembly to distribute pyrotechnic charge therein.

Pyrotechnic initiators have many uses in industrial and consumer applications. One important use is in triggering the inflation of airbags in motor vehicles. Significant efforts have been made in the automotive industry to reduce the cost of manufacturing reliable airbag initiators. One advance has been the use of liquids and slurries in loading pyrotechnic charges into the initiators. As shown in U.S. Pat. No. 5,686,691 to Hamilton et al., it is known to load a slurry charge into a conventionally cup-shaped charge can, and to directly affix such a loaded can onto a header assembly so that the charge comes into contact with the header surface and bridgewire. A slurry may also be loaded into an initiator subassembly with the aid of a charge sleeve, as is taught in applicant's co-pending U.S. application Ser. No. 09/733,755 by Avetisian et al., which was filed on Dec. 8, 2000 and entitled "Pyrotechnic Initiator with a Narrowed Sleeve Retaining a Pyrotechnic Charge and Methods of Making Same."

Loading a slurry directly into the charge can, however, poses drawbacks and difficulties relating to loading and proper retention of the charge against the bridgewire and the need for consolidation limits the range of suitable charge formulations. Loading a slurry without consolidation also poses drawbacks and difficulties in evenly loading the charge and in obtaining a dried slurry charge that contains a minimum of voids in the region of the bridgewire. If a slurry charge is loaded and not subjected to a consolidation force, there may be irregularities, uneven distribution, and excess voids in the region of the bridgewire, all of which may result in less reliable and predictable performance of the initiator. A centrifuge process may be used to distribute slurries evenly, however, this is a very costly process both in terms of initial investment and production maintenance. Vibratory and ultrasonic consolidation techniques are also known, however, they are not as reliable. Also, a tool may be used to tamp down the slurry (preferably when it is neatly dried), but this may be more difficult to do since the degree of slurry dryness must be accurately known, and the slurry may stick to the tool when it is wet. It is believed that heretofore, a method of axially spinning an initiator subassembly to distribute a pyrotechnic charge therein has never been utilized to address any of the foregoing problems.

SUMMARY OF THE INVENTION

In accordance with the present invention, an initiator subassembly is axially spun on its long axis (i.e., around the axis of the initiator subassembly that is perpendicular to the surface of the header assembly) to distribute pyrotechnic charge therein. This axial spinning is preferably done during the distribution of a slurry charge into the initiator subassembly; also, it may be done while an ignition charge is still in a slurry state, and/or it may be done while a separate output charge is still in a slurry state.

DETAILED DESCRIPTION OF A PREFERRED EMBODIMENT

The present description incorporates by reference in full the disclosures of the following co-pending applications that are filed concurrently herewith and assigned to the assignee of the present application: Ser. No. 10/188,402, entitled "Initiator with a Slip Plane Between an Ignition Charge and an Output Charge" by Vahan Avetisian et al.; Ser. No. 10/188,004, entitled "Initiator with a Bridgewire in Contact with Slurry-Loaded Pyrotechnic Charge at a Position of Relatively Low Void Formation," by Vahan Avetisian et al.; Ser. No. 10/188,010, entitled "Initiator with a Bridgewire Configured in an Enhanced Heat-Sinking Relationship," by Vahan Avetisian; and Ser. No. 10/188,003, entitled "Initiator with an Internal Sleeve Retaining a Pyrotechnic Charge and Methods of Making Same," by Vahan Avetisian et al. U.S. Pat. No. 5,648,634 to Avory et al. is also incorporated herein by reference.

Figure 1:
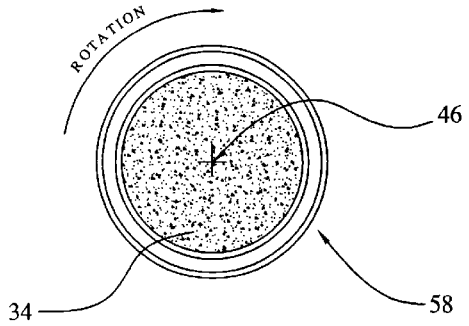
FIG. 1 is a top view of a loaded header and sleeve assembly compatible with the inventive method, showing the direction in which the assembly is spun about its long axis.
Figure 2:
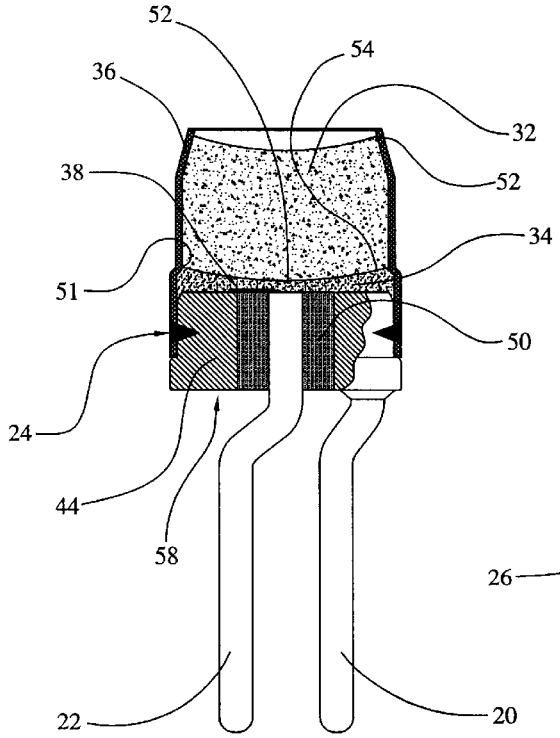
FIG. 2 is a side sectional view of the loaded header and sleeve assembly of FIG. 1.
Figure 3:
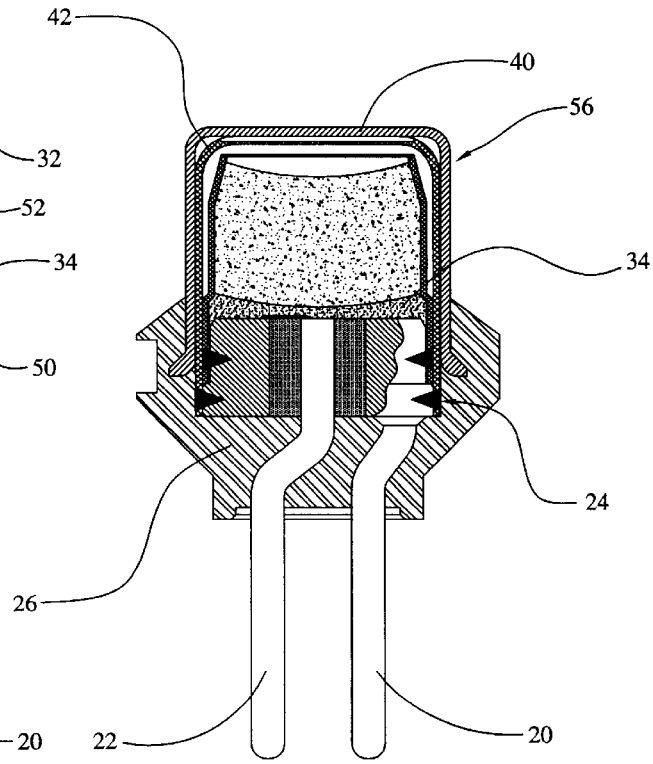
FIG. 3 is a side sectional view of an initiator incorporating the loaded header and sleeve assembly of FIGS. 1 and 2.

Various initiator configurations can be used, or modified appropriately for use, in the present invention. As can be seen from FIGS. 1–3, a preferred embodiment of an initiator 56 compatible with the method of the present invention preferably includes a number of features typically found in pyrotechnic initiators. For example, there is a glass-to-metal sealed header and loaded sleeve assembly 58 hermetically attached to a charge can 42 through a circumferential weld 24, an insulator cup 40, and a molded insulating body 26. The depicted header assembly consists of an isolated center pin 22, glass 50, an eyelet 44, a welded bridgewire 38, and a ground pin 20, with both of the pins 20 and 22 extending beyond the body 26 to form a connector end. The eyelet 44 is preferably made of a metal such as 304L stainless steel, and is generally cylindrical with a passage defined through it to permit a feedthrough to be created by the hermetic sealing of the glass 50 and the center pin 22 therein. The depicted header and sleeve assembly 58 includes a concentrically placed passage, center pin and glass, however, they could alternately be eccentrically placed, or the header could be non-coaxial with two pins each sealed in a feedthrough. The glass 50 may preferably consist of sodium aluminosilicate or barium alkali silicate, and the bridgewire 38 may be formed from a high resistance metal alloy such as platinum-tungsten or "NICHROME" nickel-chromium alloy. The ignition charge 34 (also known as a primer charge) may preferably be zirconium/potassium perchlorate-based and is in a heat-receiving relationship with the bridgewire 38. A firing current having at least a predetermined "all-fire" level and duration (e.g., 800 mA for 2 milliseconds at −35° C.) applied to the pins 20 and 22 resistively generates heat that is reliably (e.g., 99.9999% of the time with at least 95% confidence) sufficient to ignite the ignition charge 34. It is also generally required that the application of current up to a predetermined "no fire" level and duration (e.g., 200 mA for 10 seconds at 85° C.) will reliably not result in the bridgewire generating sufficient heat to ignite the charge 34. As an alternate to the bridgewire 38, a monolithic bridge may be used, and preferably consists of dissimilar conductive materials such as a thick resistive film on a ceramic substrate, a thin resistive film deposited on a ceramic substrate, or a semiconductor junction diffusion doped onto a silicon substrate, examples of each of which are well-known in the art. Output charge 32 may also preferably be zirconium/potassium perchlorate-based.

In the depicted embodiment, a sleeve 36 having a cylindrical aspect contains the charges 34 and 32 within the initiator and may have a narrowing 51 to facilitate the retention of charge 34 in place against the top surface of the header assembly 58, preferably so that it is in intimate contact with the bridgewire 38. This sleeve 36 can be formed, for example, from a hollow generally cylindrical piece of 304L stainless steel having a wall thickness of ten thousandths of an inch, which is then swaged inwardly (using a suitable special-formed tool designed for the application such as is well-known in the art) at its top to form a narrowed top end 52. The sleeve 36 can then be slid onto the header assembly and its bottom end can then be circumferentially welded to the eyelet 44 with a through-weld 24. The sleeve 36 preferably has a relatively tight interference fit with the header assembly so as to secure it firmly thereto and reduce the likelihood of the charges 34 and 32 shifting.

Following that, a layer of ignition charge 34 is distributed onto the top surface of the header assembly. As depicted, this can preferably be done while spinning the header and sleeve assembly 58 around its axis 46, so as to exert a centrifugal force on the charge 34 and causing a depression 52 to be formed in the center of the charge 34, and a heightened portion 54 to slopingly form toward the outer circumference of charge 34. This has been accomplished with a standard rotary vane air motor operating at 90 psi and a fixture (not shown) specially designed to hold the depicted part, at a rotation rate of 1000 rpm. The fixture includes a nest adapted (as is well-known in the art) to receive each header and sleeve assembly 58 one at a time, with the pins 22 and 20 pointing down. The part is held and axially spun preferably for the duration of the time in which a standard metering pump (such as the Digispense available from IVEK, Inc., North Springfield, Vt.) slurry-distributing nozzle is loading the predetermined load (for example, preferably a predetermined amount between 20 mg to 60 mg, such as 30 mg) of ignition slurry into the header and sleeve assembly, which is preferably a predetermined period of time between 0.5 to 1.5 seconds.

Following that, the ignition charge 34 is preferably dried, and then output charge 32 is similarly loaded as a slurry while the part is axially spun during the loading. In this fashion, generally symmetric depressions are formed in both the top of the ignition charge 34 and the top of the output charge 32. Alternately, it may be desired to only axially spin one of the charges. In such case, it may instead be desired to centrifuge (i.e., revolve the header assembly perpendicularly to its long axis) the charge that is not spun. For example, the header and sleeve assembly 58 could be centrifuged, preferably at a rotation rate of 2000 rpm to 4000 rpm for 0.5 to 1.5 seconds, during the loading of the ignition charge 34, and the ignition charge 34 then dried so as to create a flat top surface (and thus a slip plane as described that helps minimize the physical and environmental stresses affecting the charge near the bridgewire 38, as taught in assignee's co-pending application Ser. No. 10/188,402 entitled "Initiator with a Slip Plane Between an Ignition Charge and an Output Charge" by Vahan Avetisian et al., (Express Mail No. EU124494039US)), followed by axially spinning the part during the loading of output charge 32. Less preferably, the converse could be done. Also less preferably, the output charge 32 could be loaded before the ignition charge 34 dries, with both charges being axially spun during or after the loading of the output charge 32.

It is noted that the depiction of depression 52 is somewhat exaggerated, because in the preferred embodiment, the height of depression 52 is preferably about 10% lower in height than the heightened portion 54. Nevertheless, the axial spinning in the preferred embodiment (having the ignition charge slurry composition described below) results in a high degree of elimination of voids in the dried slurry, particularly in the area of the depression 52. This is accomplished without the need for directly pressing on the slurry charge, which presents difficulties as noted above.

Some examples of relevant slurry-loadable pyrotechnic compositions are described in U.S. Pat. No. 5,686,691 to Hamilton, et al., the disclosure of which is incorporated herein by reference except to the extent that it contradicts anything explicitly set forth here. A preferable slurry for use in forming output charge 32 in the present embodiment may include a binder such as. Viton-B® preferably at less than five percent by weight, a solvent such as butyl acetate at approximately twenty percent by weight, and the balance preferably being zirconium/potassium perchlorate and any other desired additives. A preferable primer charge 34 may be formed from a slurry including a binder such as Nipol® AR53L preferably at a few tenths of a percent by weight, a solvent such as butyl acetate at approximately twenty percent by weight, and the balance preferably being zirconium/potassium perchlorate and any other desired additives. The binder in the ignition charge 34 preferably has an extremely high coefficient of elasticity, such as 1000%, and is preferably extremely adhesive so as to strongly bind to the bridgewire. If the ignition charge is axially spun as described above, a preferable viscosity is 1000 to 10000 centipoise, with a most preferable viscosity having been found to be 2000 centipoise. In the depicted preferred embodiment, the total charge weight is 260 mg.

It is noted that the method of the present invention, applied to a slurry, may also provide the additional benefit of assisting in the separation of the slurry stream from the dispenser tip, improving the consistency of the manufacturing process.

Initiators having various other configurations than that depicted in the Figures are amenable to the axial spinning of the present invention, such as suitable configurations shown in assignee's co-pending application Ser. No. 10/088,003, entitled "Initiator with an Internal Sleeve Retaining a Pyrotechnic Charge and Methods of Making Same," by Vahan Avetisian et al., (Express Mail No. EU124494073US). It is also noted that the bridgewire 38 may preferably be in close contact with the glass 50, and/or may be flattened, as is taught in assignee's co-pending application Ser. No. 10/088,010, entitled "Initiator with a Bridgewire Configured in an Enhanced Heat-Sinking Relationship," by Vahan Avetisian, (Express Mail No. EU124494060US). The bridgewire 38 is also preferably located in a position near the depression 52 so as to be in contact with the charge 34 at a position of the charge 34 that was subject to a relatively high degree of contraction during the slurry drying process (thus minimizing the presence of voids in the charge 34 at the position of the bridgewire 38), as described in assignee's copending application Ser. No. 10/088,004, entitled "Initiator with a Bridgewire in Contact with Slurry-Loaded Pyrotechnic Charge at a Position of Relatively Low Void Formation," by Vahan Avetisian et al., (Express Mail No. EU124494042US).

A method of axially spinning an initiator subassembly to distribute pyrotechnic charge therein has thus been disclosed. It will be apparent, however, that various changes may be made in the form, construction, and arrangement of the parts without departing from the spirit and scope of the invention, the form hereinbefore described being merely a preferred or exemplary embodiment thereof. For example, a non-pyrotechnic charge may also be used in the present invention. Therefore, the invention is not to be restricted or limited except in accordance with the following claims.

What is claimed is:

1. A method of assembling an initiator, comprising the following steps:

a) providing a header assembly including an eyelet, a circumferential charge enclosure, a top surface including an exposed electrical initiating element on said top surface, and an axis substantially perpendicular to said top surface;

b) loading a first charge within said circumferential charge enclosure; and, c) axially spinning said header assembly while said first charge is within said circumferential charge enclosure.

2. The method of claim 1, wherein said electrical initiating element is a bridgewire.

3. The method of claim 1, wherein step c) includes axially spinning said header assembly at a rotation rate of between 100 rpm and 5000 rpm, and the viscosity of said first charge is between 1000 centipoise and 10000 centipoise, said rotation rate and said viscosity being selected to result in a desired degree of movement of said first charge.

4. The method of claim 1, wherein step b) occurs before step c).

5. The method of claim 1, wherein steps b) and c) are simultaneous.

6. The method of claim 5, wherein said step b) comprises loading said first charge in the form of a slurry.

7. The method of claim 6, wherein said first charge is an ignition charge.

8. The method of claim 7, wherein step c) creates a depressed central area in said ignition charge, and said electrical initiating element located on the top surface of said header assembly in the region of said depressed central area.

9. The method of claim 8, wherein said first charge slurry contains a binder at less than one percent by weight, a solvent at between ten to thirty percent by weight, and zirconium/potassium perchlorate.

10. The method of claim 1, wherein said circumferential charge enclosure is a charge sleeve.

11. The method of claim 10, further comprising the step hermetically affixing a charge can to said header assembly.

12. The method of claim 10, wherein said charge sleeve has a narrowed top end, and said charge has a largest outer diameter that is greater than the inner diameter of said narrowed top end of said sleeve.

13. The method of claim 1, wherein said first charge is an output charge, the method further comprising the step of loading a slurry ignition charge onto the top surface of said header assembly and simultaneously centrifuging said header assembly with said slurry ignition charge on the top surface of said header assembly.

14. The method of claim 13, further comprising the step of providing an intermediary slip plane between said ignition charge and said output charge.

15. The method of claim 14, wherein said output charge is non-monolithic when said initiator is fully assembled, and is thus incapable of transmitting substantial lateral force components or torque to said ignition charge.

16. The method of claim 13, wherein said slurry ignition charge includes a binder at less than five percent by weight and a solvent at between ten to thirty percent by weight.

17. An initiator made according to the following steps:

a) providing a header assembly including an eyelet, a circumferential charge enclosure, a top surface including an exposed electrical initiating element on said top surface, and an axis substantially perpendicular to said top surface;

b) loading a first charge within said circumferential charge enclosure; and, c) axially spinning said header assembly while said first charge is within said circumferential charge enclosure.

18. The initiator of claim 17, wherein said first charge is an output charge, said initiator further comprising a centrifuged ignition charge.

19. The initiator of claim 17, wherein said first charge is an ignition charge.

20. The initiator of claim 19, wherein said first charge contains a binder and zirconium/potassium perchlorate.

* * * * *